United States Patent [19]

Diaz

[11] Patent Number: 4,993,686

[45] Date of Patent: Feb. 19, 1991

[54] TRANSMISSION WORK STATION

[76] Inventor: Eusebio M. Diaz, 6450 Balboa Blvd., Van Nuys, Calif. 91406

[21] Appl. No.: 274,307

[22] Filed: Nov. 21, 1988

[51] Int. Cl.[5] ..... B66F 3/00

[52] U.S. Cl. ..... 254/133 R; 254/93 R; 254/DIG. 16; 269/69; 269/71; 269/76; 269/296; 269/289 MR

[58] Field of Search ..... 269/17, 55, 65, 71, 269/74, 76, 69, 208, 289 R, 289 MR, 296, 130, 131, 900; 254/93 R, 129, 131, 133 R, DIG. 16

[56] References Cited

U.S. PATENT DOCUMENTS

| | | | |
|---|---|---|---|
| 4,164,345 | 8/1979 | Arnold et al. | 269/69 |
| 4,362,295 | 12/1982 | Ford | 269/69 |
| 4,383,681 | 5/1983 | Walters | 254/133 R |
| 4,558,849 | 12/1985 | Wening et al. | 254/133 R |
| 4,560,151 | 12/1985 | Grundy | 254/DIG. 16 |
| 4,691,904 | 9/1987 | Armstrong | 254/DIG. 16 |
| 4,796,861 | 1/1989 | Petty | 254/133 R |

*Primary Examiner*—J. J. Hartman
*Attorney, Agent, or Firm*—Albert O. Cota

[57] ABSTRACT

A universal transmission work station (10) designed for use by a single person to mount and service any model or type of automatic transmission (50). Thus, the invention solves the problem of needing more than one work station to service the various models/types of transmissions used today. The work station (10) requires a minimum work space, is easily stowed when not in use and is easily dismantled for storage or shipment. The work station consists of eight common assemblies and a ninth assembly especially designed to service frontwheel drive transmissions. The design basically consists of a base assembly (12) to which is attached a lower and upper pivoting assembly (14) (16). After the transmission (50) is mounted to the work station, by means of a tail housing support assembly (18) and a bell-housing mounting plate assembly (20), the pivoting assemblies (14) (16) can be tilted to allow the transmission (50) to be serviced in a horizontal position.

12 Claims, 6 Drawing Sheets

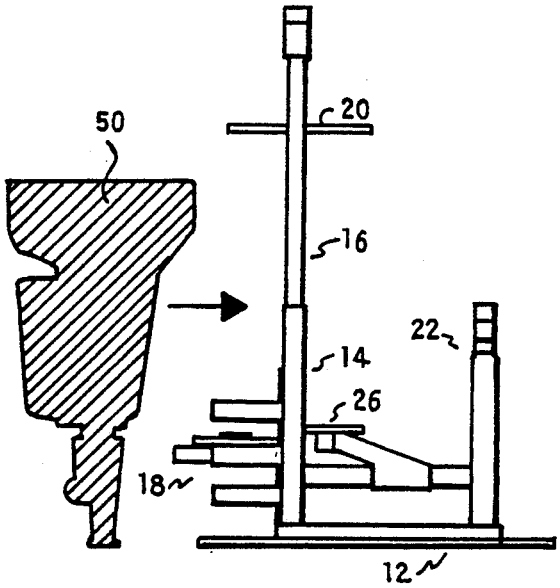
Fig.8A
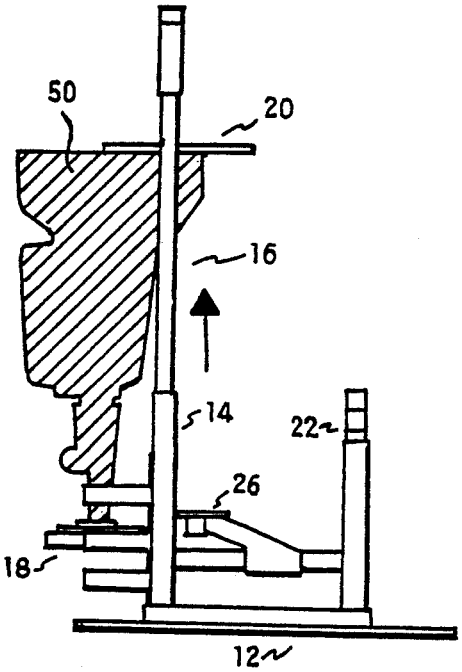
Fig.8B
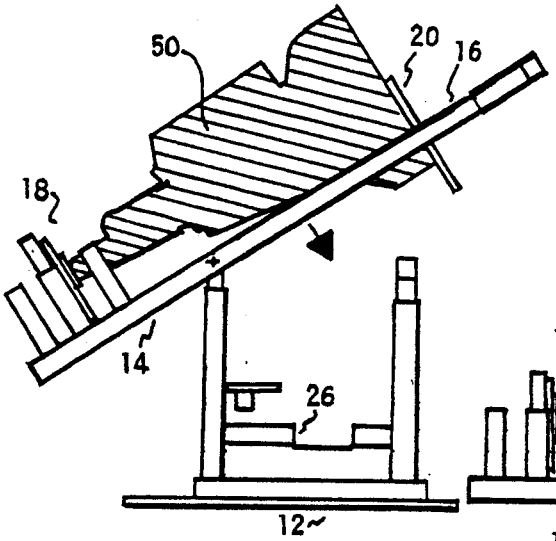
Fig.8C
Fig.8D
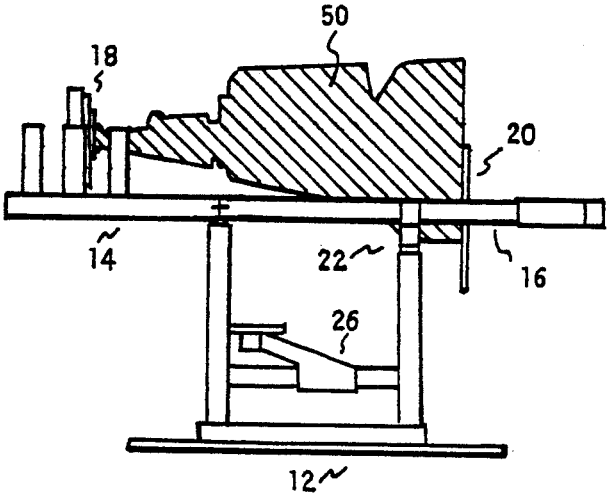

TRANSMISSION WORK STATION

TECHNICAL FIELD

The invention pertains to the general field of automotive work stations used to assemble and disassemble automotive parts and more particularly to a universal transmission work station used to service/rebuild conventional and front-wheel drive automatic transmissions.

BACKGROUND ART

The automotive automatic transmissions used in current vehicle models are complex and require considerable expertise in servicing/rebuilding. There are today various types of work stations that are designed to service/rebuild a specific model or type of transmission. Each automobile manufacturer supplies their service centers with work stations and tools to work on their specific transmission models. Thus, there is no universal transmission work station that can be used, especially by independent mechanics, to service the different types and models of transmission manufactured by the various automobile companies.

In order to efficiently service all the various types and models of automatic transmission in use today, it is necessary to have more than one work station. This situation is not cost effective in terms of capital expenditure and time and requires storage space, One problem with many of the current work stations is that it requires more than one person to mount and dismount the automatic transmission. In one man shops, this problem is especially critical.

A search of the prior art did not disclose any patents that read directly on the claims of the instant invention however, the following U.S. patents were considered related:

| U.S. Pat. No. | INVENTOR | ISSUED |
|---|---|---|
| 4,077,103 | Kelley | Mar. 7, 1978 |
| 3,871,055 | Dail | Mar. 18, 1975 |
| 3,163,928 | Shafer | Jan. 5, 1965 |
| 3,099,875 | Lelis | Aug. 6, 1963 |
| 2,992,478 | Baker | Jul. 18, 1961 |
| 2,697,273 | Clarke, et al | Dec. 21, 1954 |
| 1,473,811 | Cantrell, et al | Nov. 13, 1923 |
| 1,346,868 | Wilson | Jul. 20, 1920 |

The Kelley patent discloses a pulling tool for removing a shaft from a hub on a fan or blower. The tool has a screw for seating against one end of the shaft and a nut threaded on the screw with four screws engaging the hub of the blower wheel at 90 degree intervals. Further, gripping means are four hook-like fingers that grip the skirt on one end and grasp the hub of a propeller fan on the other. These fingers are rotated out of the way into spring clips when not in use.

The Dail patent discloses a foot actuated press assembly for engaging a pressable portion of a work piece and exerting a force to hold the work piece in place. The invention consists of an upright tube having a horizontal work piece support plate mounted therein. A plunger rod is disclosed inside of the upright tube and is connected to a pivotally mounted foot pedal which is spring biased to assume an upper position. A downward movement of the pedal results in a work piece engager exerting a downward pressure on the work piece to hold it in place.

The Shafter patent is concerned with pulling a hub from an axle of a motor vehicle. This invention utilizes the principle of direct force application to the inside surface of the wheel flange with the reaction being placed against a backing plate. The clamping force is accomplished by the tool having a "C" shaped portion on each end of a flat strap slipping over a flange and a wing bolt in the center.

The Lelis patent discloses a work holding device for accomplishing the disassembly, assembly and holding of units relating to automatic transmissions. The device includes a stand having a table and a frame. A vertical actuating rod is disposed through the table and includes, at its lower end, a foot pedal for alternately raising and lowering the actuating rod. The rod also functions in combination with a flanged work member that is selectively adjustable upon the rod so as to accommodate the varying heights of equipment being worked.

The Baker patent discloses a means for pulling the axle from a wheel flange in an automobile. This is accomplished by the use of a bridging member having a serrated surface on the underside and slots through which securing bolts extend. Baker in most cases uses the movable hook bracket over the flange with a rotating member in the center.

The Clarke, et al patent utilizes a pulling device to which they have combined a jack screw with a slide hammer for inertial energy. The device has the adaptability to change heads to incorporate different sizes and configuration of work pieces.

DISCLOSURE OF THE INVENTION

The transmission work station is compactly designed to allow one person to easily and safely mount, dismount and service/rebuilt a conventional or front-wheel drive automatic transmission.

The transmission work station consists of eight assemblies that are common to all transmissions and a ninth assembly that is specifically designed to service/-rebuilt front-wheel drive automatic transmissions. The common assemblies include a base assembly, a lower pivoting assembly, an upper pivoting assembly, a tail housing support assembly, a bell-housing mounting and utility plate, a rear transmission cradle assembly, a lift roller assembly and a pivot shaft sleeve lift assembly. The ninth specialty assembly is a front-wheel drive transmission mounting assembly.

The base assembly consists of a base plate to which is attached a center port sleeve, a lower vertical support sleeve and a longitudinal support attached between the center port and the lower vertical support sleeves. The lower pivoting assembly consists of a right and left vertical sleeve with each having normally attached a support sleeve or a plurality of support sleeves, this assembly also has a combination support sleeve attachment and roller plate that is attached to the back of each of the right and left vertical sleeves, a center post that fits into the center post sleeve on the base assembly and that has on its upper end a pivot shaft sleeve. Into this sleeve is inserted a pivot shaft that is attached to the inside surfaces of the right and left vertical sleeves to thus allow these sleeves to pivot about the pivot shaft sleeve.

The upper pivoting assembly consists of a right and left pivotal member. These members are connected at their upper ends by a handle and their lower ends are inserted into the respective right and left vertical sleeves located on the lower pivoting assembly. The tail housing support assembly consists of a tail housing plate having a shaft insertion bore therethrough and a means to attach the plate to the right and left support sleeves.

The bell-housing mounting and utility plate assembly consists of a mounting and utility plate having a set of transmission mounting bores that are specifically spaced to allow a variety of transmission bell housings to be attached. This assembly has the means to allow it to be attached to the right and left pivotal members on the upper pivoting assembly. The rear transmission cradle assembly consists of a vertical support member that fits into the lower vertical support sleeve located on the base assembly. To the upper end of the vertical support member is attached a horizontal member that is configured to allow the upper pivotal assembly to be held when the combination of the right and left pivotal members are pivoted to recline in a horizontal or other selected angular position.

The lift roller assembly consists of an upwardly angled member that is sized to fit into and be held within the longitudinal support on the base assembly. Attached to its forward end is a T-section member having on each end an adjustable roller that is adjusted so that it rolls easily along the roller plate located on the lower pivoting assembly. The final common assembly is the pivot shaft sleeve lift assembly. This assembly may consist of one or two lifts that have a cradle sized to encompass the diameter of the pivot shaft sleeve. The lift(s) may be either pneumatic or hydraulic and are operated remotely by a control valve connected to either a pneumatic or hydraulic source.

The ninth specialty assembly is the front-wheel drive transmission mounting assembly. This assembly consists of a lower telescoping horizontal member and a stationary horizontal member. Each of these members have inward ends that are sized to fit into a pair of the lift support sleeves located on the lower pivoting assembly. The outward ends of these members are attached to a lower vertical sleeve that is attached to an upper vertical sleeve via a slideable extension post On the top of the upper vertical sleeve is swivelly attached a swivelling horizontal sleeve into which is inserted an extension arm. The arm has mounted to its upper inward end a bell housing mounting plate that includes a set of transmission mounting bores that allows a variety of front wheel drive transmission bell housing to be attached. This assembly also includes a means to allow the assembly to be adjusted for elevation.

To use the transmission work station to service/rebuild a conventional automatic transmission, the transmission output shaft is inserted into the shaft insertion bore located on the tail housing plate and the transmission bell housing is attached to the mounting and utility plate. The work station may then be lifted and tilted to any suitable work position. To service a front-wheel drive automatic transmission, the front-wheel drive transmission mounting assembly is inserted into the upper and lower left support sleeves located on the lower pivoting assembly. The combination swivelling horizontal sleeve and extension arm is pivoted away from the station and the transmission output shaft is inserted into the shaft insertion bore. The pivoting sleeve and arm is then pivoted inwardly to allow the bell housing mounting plate to be located under the transmission bell housing. The assembly is then adjusted for the proper elevation to allow the plate to be attached to the transmission bell housing or transmission case.

In view of the above disclosure, it is the primary object of the invention to have a transmission work station that allows a single person to mount, dismount and service/rebuilt either a conventional or a front-wheel drive automatic transmission.

It is also an object to have a work station that allows any model or type of automatic transmission to be serviced/rebuilt.

In addition to the above objects, it is also an object of the invention to have a transmission work station that:

- can be easily stored when not in use or that can be easily dismantled for a more confined storage or shipment,
- can be raised, lowered or tilted to any convenient work position,
- is designed to allow a variety of auxiliary tools to be used with or mounted to the work station,
- is virtually maintenance free,
- is reliable, and
- can be cost-effectively manufactured.

These and other objects and advantages of the present invention will become apparent from the subsequent detailed description of the preferred embodiment and the claims taken in conjunction with the accompanying drawings.

BRIEF DESCRIPTION OF THE DRAWINGS

FIG. 8 shows four views of the transmission work station and a transmission.

FIG. 8A shows the transmission about to be installed.

FIG. 8B shows a transmission mounted in the work station in a vertical position FIG. 8C shows the work station in an angled position.

FIG. 8D shows a transmission in a full horizontal position.

BEST MODE FOR CARRYING OUT THE INVENTION

Figure 1:
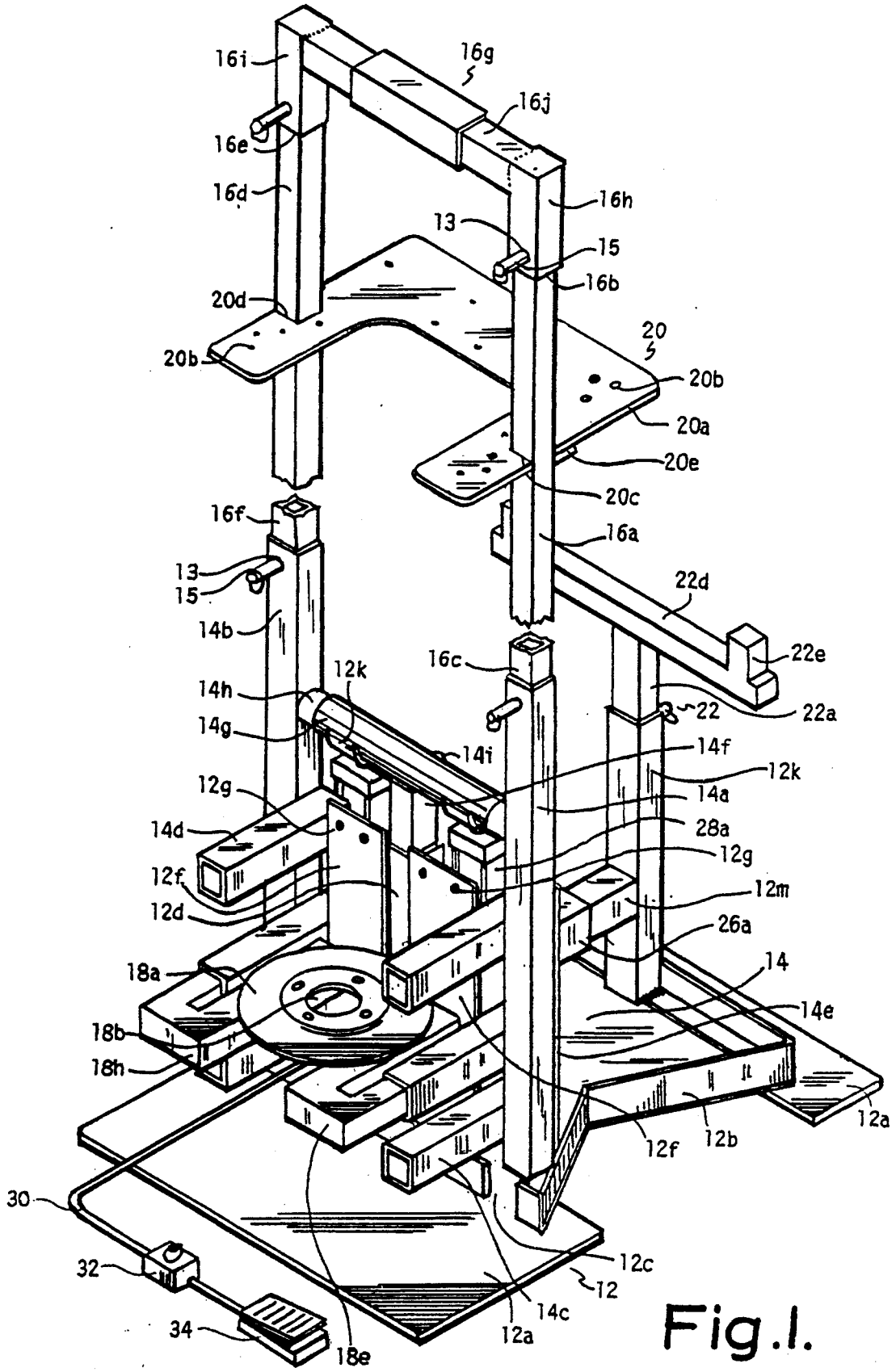
FIG. 1 is a partial perspective view of the transmission work station in a vertical position as seen from the front.

The best mode for carrying out the transmission work station is presented in terms of a preferred embodiment that is primarily designed to provide a compact and versatile work station for mounting and repairing/rebuilding various types of vehicle automatic transmissions.

The preferred embodiment, as shown in FIGS. 1 through 8 is comprised of the following nine major assemblies: a base assembly 12, a lower pivoting assembly 14, an upper pivoting assembly 16, a tail housing support assembly 18, a bell-housing mounting and utility plate assembly 20, a rear transmission cradle assembly 22, a lift roller assembly 26, a pivot shaft sleeve lift assembly 28 and a front-wheel drive transmission mounting assembly 36.

Figure 3:
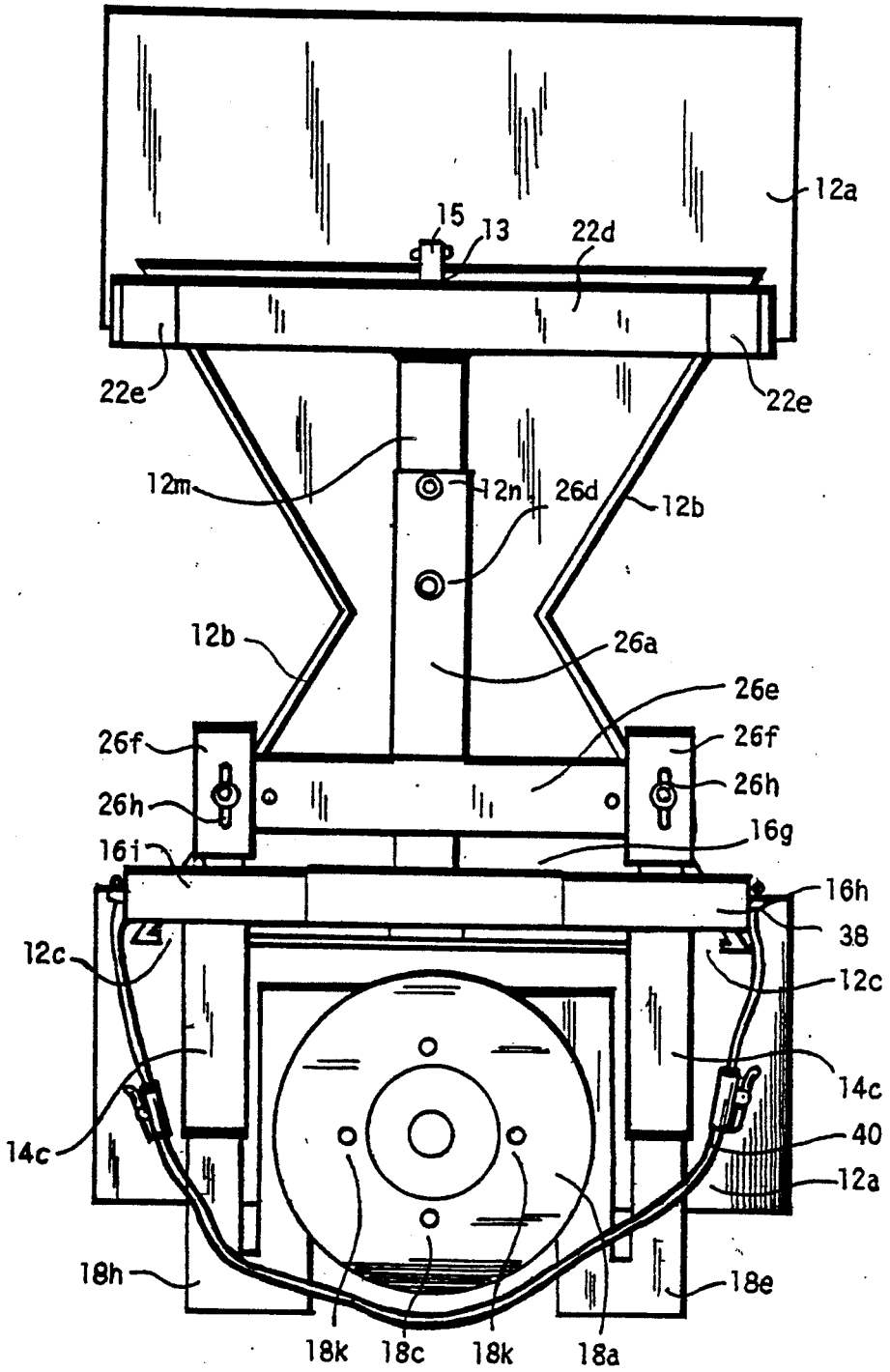
FIG. 3 is a top view of the transmission work station.
Figures 4, 7:
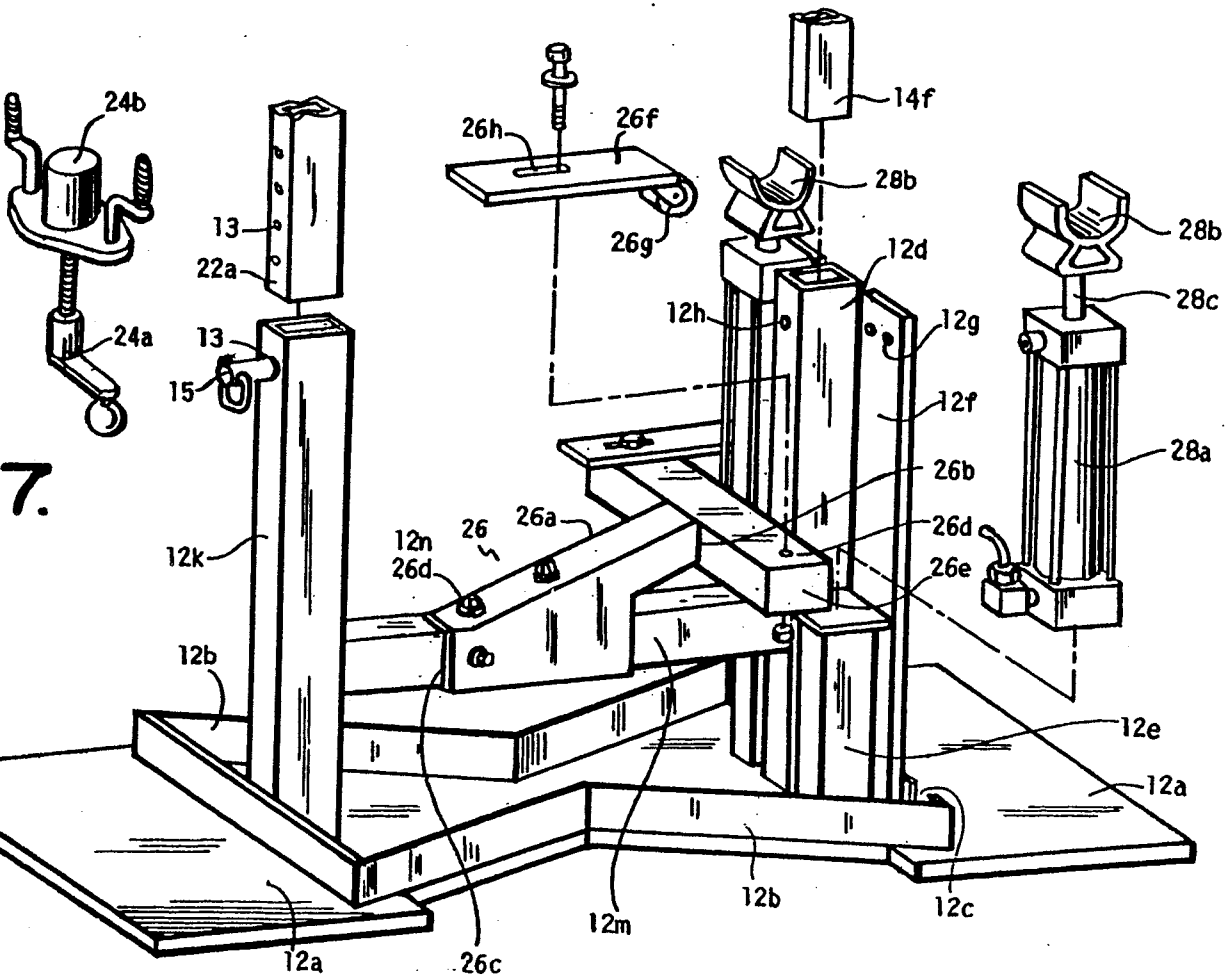
FIG. 4 is a partial perspective view of the transmission work station as seen from the rear.
FIG. 7 is a perspective view of the transmission output shaft adjustment crank.

The base assembly 12, as best shown in FIGS. 1 and 4, serves as the base support for the transmission work station 10 and includes a base plate 12*a* having a front and back section. Longitudinally attached to the surface of the base plate 12*a* is an enclosed reinforcing frame 12*b* as shown in FIGS. 1 and 3. The forward end of the frame has on each side a clearance slot 12*c* that is sized to allow the respective right and left vertical sleeves 14*a*, 14*b* to clear the frame when the combination upper and lower pivoting assemblies are tilted as described infra.

Also attached to the base plate and frame is a center post sleeve 12*d*. This sleeve includes on its back upper surface, a safety pin bore 12*h*, as shown in FIG. 4, that is sized to accept a safety pin 12*i* that is inserted when the desired elevation has been reached. Adjacent to each side of the center post sleeve and attached to the base plate 12*a*, is a lift pedestal 12*e*. On the front side of each of the two pedestals is attached a lift mounting plate 12*f* where each plate has a set of lift attachment bores 12*g*.

To the back section of the base plate 12*a*, against the frame 12*b*, is attached a cradle support sleeve 12*k* that includes a single pin bore 13. Between the front of the cradle support sleeve 12*k* and the back of the center post sleeve 12*d* is attached a longitudinal support 12*m* as best shown in FIG. 4. On the upper side of the support is located a plurality of bolt bores 12*n*.

Figure 5:
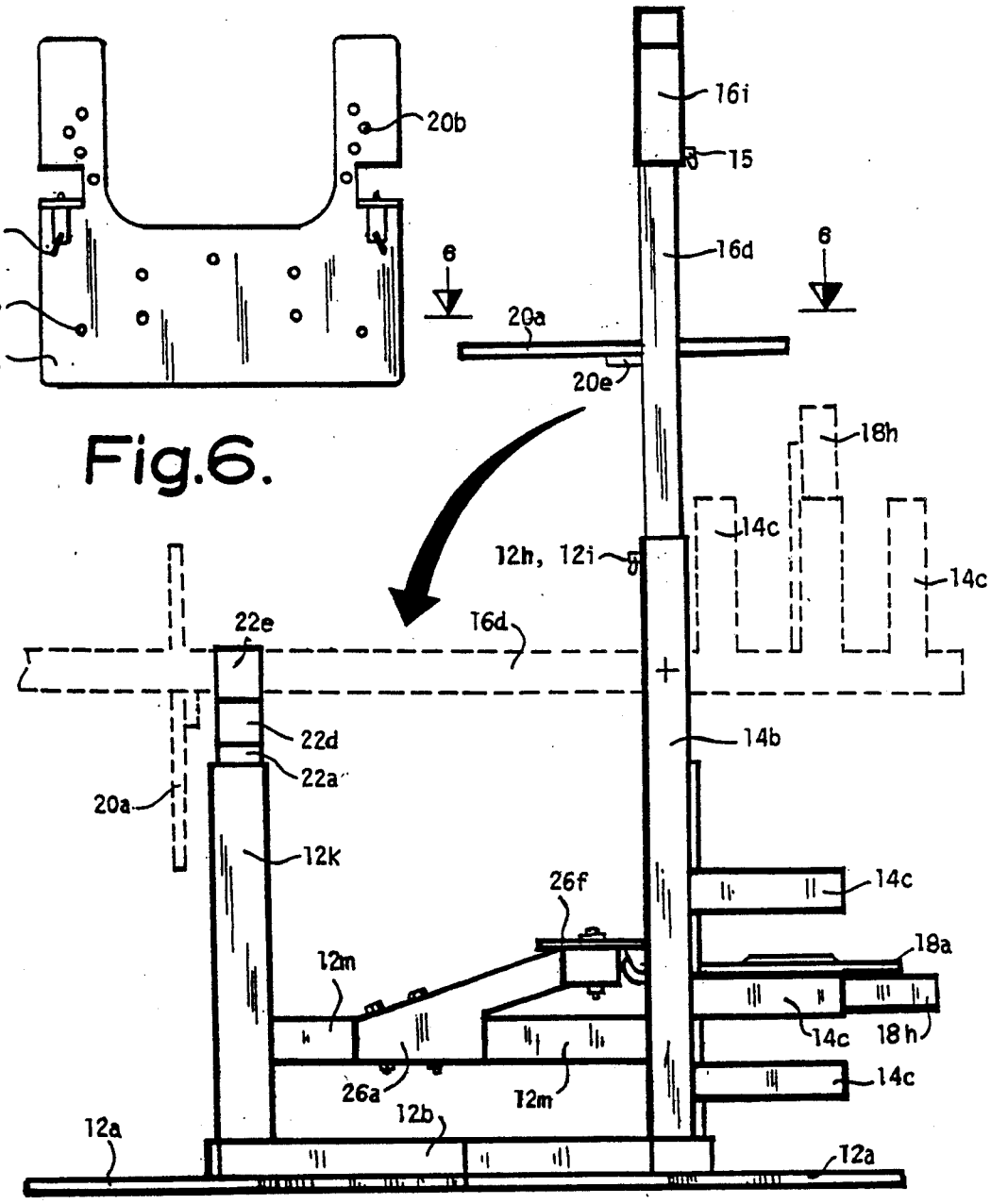
FIG. 5 is a left side view of the work transmission station shown in an upright position and also, in phantom lines, in a full horizontal position resting against the rear transmission cradle assembly.

The lower pivoting assembly 14 functions in combination with the upper pivoting assembly 16 to provide a tilting structure for the transmission work station 10 as shown in FIG. 5. The assembly 14 consists, as shown best in FIG. 2, of a right vertical sleeve 14*a* and a left vertical sleeve 14*b* both of these sleeves have on their upper end a pin bore 13. The bottom ends of the sleeves, when the assembly is pivotally attached as explained infra, is easily located inside the forward end of the reinforcing frame 12*b* adjacent to the respective clearance slot 12*c*. Rigidly attached normal to the lowerhalf inside-surface of the right vertical sleeve 14*a* is a right support sleeve 14*c*. Likewise, on the left vertical sleeve 14*b* is a left support sleeve 14*d*.

To add flexibility to the transmission work station 10, there may be added, in addition to the single set of support sleeves, an upper and a lower right support sleeve 14*c* and an upper and a lower left support sleeve 14*d* as shown in FIGS. 1 and 5. By having three sets of support sleeves, various transmission lengths can be better accommodated. Additionally, the upper and lower left support sleeves 14*d* are used to support a front wheel drive transmission mounting assembly 36 described infra.

On the back surface of each of the right and left vertical sleeves is attached a combination support sleeve attachment and roller plate 14*e*. This plate has a width that allows a further attachment point for the back of the horizontal support sleeves and functions as a roller plate for the rollers 26*g*. The lower pivoting assembly 14 also consists of a center post 14*f* that is sized to slideably fit into the center post sleeve 12*d* and that has a plurality of safety pin bores 14*j* that are sized to correspond with the safety pin bore 12*h* on the center post sleeve 12*d*. On the center posts upper end, as shown in FIG. 1, is centrally attached a pivot shaft sleeve 14*g*. Slideably inserted into this pivot shaft sleeve is a pivot shaft 14*h* that has its ends, as also seen in FIG. 1, rigidly attached to the respective upper-half inside-surface of the right and left vertical sleeves. When so attached, the right and left vertical sleeves are free to pivot about the pivot shaft sleeve 14*g*.

Figure 2:
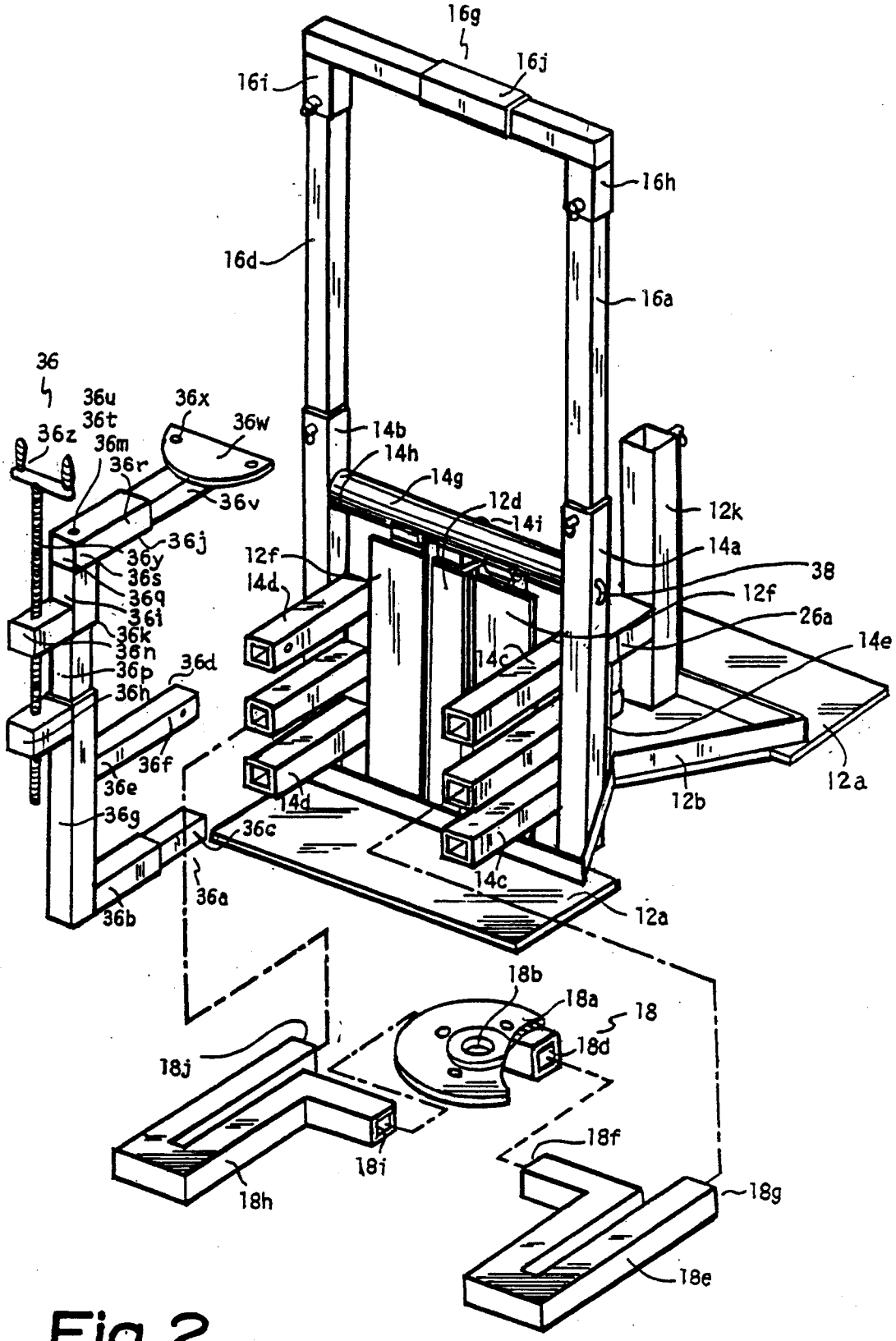
FIG. 2 is a partial perspective view of the transmission work station showing the front wheel drive transmission mounting assembly and an exploded view of the tail housing support assembly.

The pivot shaft sleeve may also include a threaded bore that allows a threaded hand knob 14*i* to be inserted. When the knob is tightened, against the pivot shaft 14*h*, the lower and upper pivoting assemblies 14, 16 remain set in a vertical or other selectable position. A stationary set in the vertical position is especially helpful when the upper pivoting assembly 16 is being inserted into the lower pivoting assembly 14. On the outer side of each vertical sleeve may also be attached, as shown in FIGS. 2 and 3 a transmission safety strap hook or handle 38 to which is attached an adjustable transmission safety strap 40. The strap provides additional safety by providing a second means for securing the transmission 50 to the transmission work station 10.

The upper pivoting assembly 16, as best shown in FIGS. 2 and 5, consists of a right pivotal member 16a that has an upper end 16*b* and a lower end 16*c*. On each of these ends and on the center, there is located a pin bore 13. The lower end is sized to be slideably inserted into the right vertical sleeve 14*a* with the corresponding pin bores in concentric alignment and held in place with an adjustment set pin 15. The left pivotal member 16*d* is similar to the right pivotal member having an upper end 16*e* and a lower end 16*f* with each end also having a pin bore 13. The lower end is slideably inserted into the left vertical sleeve 14*b* and held in place with a set of pin bores 13 and an adjustment set pin 15.

The upper pivoting assembly 16 includes a handle 16*g*. The handle may be made in one piece with a vertical sleeve on each end that is inserted over the respective right and left pivotal members 16*a*, 16*d*. Preferably, however, as shown in FIG. 1, for easier assembly, the handle consists of a right handle support 16*h* and a left handle support 16*i*. Each of these supports has a horizontal end an a vertical sleeve with a pin bore 13. The vertical sleeves are sized to be slideably inserted over the upper ends 16*b*, 16*e* of the respective right and left pivotal members 16*a*, 16*d* with the corresponding pin bores 13 in concentric alignment and held in place with an adjustment set pin 15. The horizontal ends of the right and left handle supports are then inserted into a handle adjustment sleeve 16*j* to hold the two pivotal members in place.

The tail housing support assembly 18 provides the lower support, (the shaft end) for an automatic transmission 50. The assembly is comprised, as shown in FIGS. 1 and 2, of a tail housing plate 18*a* that has a centrally located shaft insertion bore 18*b* that is sized to accept the transmission output shaft. On the plate, as shown in FIG. 3, there are also located a set of shaft crank bores 18*c* that are used to insert a transmission output shaft adjustment crank 24. The crank 24 is comprised of a crank handle 24*a* that drives a shaft receptacle 24*b* and a U-shaped pin clamp 24*c* where the pins are inserted into the bores 18*c*. The crank is used to align the transmission output shaft to a proper position to allow the transmission snap ring to be easily inserted particularly on the General Motors and Ford automatic transmissions.

The housing plate 18*a* also includes a set of front wheel drive transmission bores 18*k*. These bores are also used to control the radial position of the transmission's output shaft. On the plate s bottom back surface there is attached a right and left bracket sleeve 18*d*.

The tail housing support assembly also includes a right bracket 18*e* having a first end 18*f* and a second end 18*g*; and a left bracket 18*h* having a first end 18*i* and a second end 18*j*. The first ends 18*f*, 18*i* are inserted into the respective ends of the right and left bracket sleeve 18*d* as best shown in FIG. 2. The completed tail housing support assembly 18 is then mounted to the transmission work station 10, as also shown in FIG. 2, by inserting the second end 18*g* of the first bracket 18*e* into one of the right support sleeves 14*c* and the second end 18*j* of the left bracket into one of the left support sleeves 14*d*. The particular set of sleeves selected is dependent upon the length of the transmission being serviced.

Figure 6:
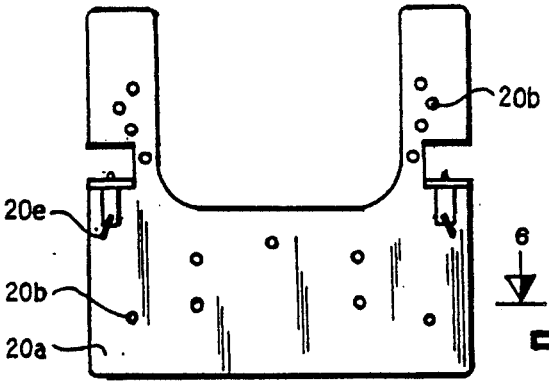
FIG. 6 is a bottom view of the mounting and utility plate.

The bell-housing mounting and utility plate assembly 20 provides upper support (the bell housing end) for the automatic transmission 50, and also functions as a utility plate where tools and transmission parts may be placed while servicing the transmission. This assembly is comprised, as shown in FIGS. 1 and 6, of a mounting and utility plate 20*a* that includes a set of transmission mounting bores 20*b*. These mounting bores are specifically sized and spaced to allow various transmission bell housings to be attached.

On each side of the assembly 20, as best seen in FIG. 6 is a right mounting slot 20*c* and a left mounting slot 20*d*. These slots are sized to fit over the respective right and left pivotal members 16*a*, 16*d* as shown in FIG. 1. Adjacent to each of the mounting slots is located a spring-loaded locking pin 20*e*. When the assembly 20 is mounted to the pivotal members, prior to attaching the bell housing, the spring-loaded locking pin is inserted into the respective center pin bore 13 located on the right and left pivotal members 16*a*, 16*d*.

The rear transmission cradle assembly 22 consists of a vertical support member 22*a* that has an upper end 22*b*, a lower end 22*c* and a plurality of pin bores 13. The lower end 22*c* is sized to slideably fit into the cradle support sleeve 12*k* as shown in FIGS. 1 and 4. The support member 22*a* is held within the sleeve 12*k* by a concentric pair of pin bores 13 and an adjustment set pin 15 as shown in FIG. 4.

To the upper end 22*b* is rigidly and centrally attached a horizontal member 22*d*. This member has on each upper end an upwardly projecting vertical section 22*e* that are spaced to allow the upper pivoting assembly 16 to fit and rest between the sections 22*e*. This condition occurs when the combination of the right and left vertical sleeves 14*a*; 14*b* and right and left pivotal members 16*a*, 16*d* pivot about the pivot shaft sleeve 14*g* to recline in an angled or horizontal position as shown in FIG. 5.

The lift roller assembly 26 provides a smooth upward and lower travel when the combination of the lower and upper pivoting assemblies are being raised or lowered. This assembly consists, as shown in FIGS. 4 and 5, of an upwardly angled member 26*a* that has a forward end 26*b*, a downwardly extending channel 26*c* sized to slideably fit into the longitudinal support 12*m* and a set of bolt bores 26*d*. The angled member 26*a* is adjusted and held in place by inserting a bolt into a concentric pair of bolt bores 12*n*, 26*d* on the channel and the longitudinal support 12*m*.

Centrally attached to the forward end 26*b* of the upwardly angled member 26*a* is a T-section member 26*e* that has a vertical bolt bore 26*d* on each end that are used to attach a roller support plate 26*f*. This plate has a roller 26*g* on its forward end and an adjustment slot 26*h*. Attachment of the plate to the T-section member 26*e* is accomplished by inserting a bolt through the slot 26*h* and the corresponding T-section bolt bore. The plate 26*f* is adjusted so that the roller 26*g* slides easily along the roller plate 14*e* located on the lower pivoting assembly 14.

The combination lower and upper pivoting assemblies are raised and lowered by means of a remotely operated pivot shaft sleeve lift assembly 28. Either one lift assembly or a pair of lift assemblies may be used to provide the lifting. If one assembly is used (not shown) the lift 28*a* is located centrally below the pivot shaft sleeve 14. Preferably, however, two lifts 28*a* are employed as best shown in FIGS. 1 and 4.

The lift assembly 28 consists of the lift 28*a* having a bottom side, that rests upon the respective lift pedestal 12*e*, and an inward side. The inward side is rigidly attached by a set of bolts inserted through a set of lift attachment bores located on the respective lift mounting plate 12*f*. The assembly 28 also includes a lift cradle 28*b* that is attached to a lift post 28*c*. The cradle is sized to encompass the diameter of the pivot shaft sleeve as shown in FIG. 1. The lifts 28*a* are operated by means of either a pneumatic lift 28*a* or a hydraulic lift 28*a*. In either case, the lift is connected as shown in FIG. 1, to an air or hydraulic line 30 connected from either an air or hydraulic source 34. In series with the line 30 and source 34 is a remotely operated air or hydraulic control valve 32 that allows the air or hydraulic power source to be applied and controlled.

The final assembly described is the front wheel drive transmission mounting assembly 36 which provides the transmission work station 10 with additional utility by allowing front wheel drive transmissions to be serviced.

The assembly 36, as shown in FIG. 2, is comprised of a lower telescoping horizontal member 36*a* and a stationary horizontal member 36*d*. The lower member 36*a* has an outward end 36*b* and an inward telescoping end 36*c* that is sized to fit into the lower left support sleeve 14*d*. The inward telescoping end includes a pin bore 13 that when in concentric alignment with the pin bore 13 on the support sleeve 14*d* is held in place by inserting an adjustment set pin 15. The stationary horizontal member 36*d* has an outward end 36*e* and an inward end 36*f* that is sized to fit into the upper left support sleeve 14*d*. The member 36*d* also has a pin bore 13 that is used to hold the member in place within the support sleeve as previously described.

The outer end 36*f* of the member 36*a* is rigidly attached to the inward lower end of a lower vertical sleeve 36*g* and the outer end 36*e* of the member 36*d* is likewise attached to the upper inward end of the sleeve 36*g*. The lower vertical sleeve 36*g* also has rigidly attached to its upper outward end a first threaded member 36*h*.

The assembly 36 includes an upper vertical sleeve 36*i* that has a lower end 36*k* and an upper end 36*j* that has a first swivel pin bore 36*m*. To the outside surface of the sleeve 36*i* is rigidly attached a second threaded member 36*n* that is located in-line with the first threaded member 36*h*. The upper end of the lower vertical sleeve 36*g* and the lower end of the upper vertical sleeve 36*i* and inserted into the lower end and upper end respectfully of a vertical extension post 36*p*.

The upper portion of the assembly 36 consists of a swivelling horizontal sleeve 36q having an inward end 36r and an outward end 36s that is on the same outward plane as that of the upper vertical sleeve 36i. Into the inward end is slideably inserted an extension arm 36v. The outward end of the sleeve 36q also has a second swivel pin bore 36t that is in concentric alignment with the first swivel pin bore 36m. Into these two pin bores is inserted a swivel pin 36u that allows the combination of the swivelling horizontal sleeve 36q and the extension arm 36v to swivel radially as shown by the arrows in FIG. 2.

On the upper inward end of the extension arm 36v is attached a bell housing mounting plate 36w. This plate has a set of transmission mounting bores therethrough that are specifically spaced to allow various models of front-wheel drive transmission bell housings to be attached.

The final element of the assembly is a crank consisting of a threaded shaft 36y and a handle 36z. The threaded shaft is threaded into the first and second threaded members 36h, 36n. When the crank is rotated by the handle 36z, the bell housing mounting plate 36w can be adjusted in elevation to accommodate transmissions of various lengths.

To assemble and operate the transmission work station 10, the following typical steps are followed:

1. set the base assembly 12 on a flat area,
2. set the two lifts 28a on the lift pedestals 12e and attach them to the respective lift mounting plate 12f,
3. insert the center post 14f into the center post sleeve 12d and allow the pivot shaft sleeve to rest upon the lift cradles 28b,
4. tighten the threaded hand knob 14i so that the lower pivoting assembly remains set in a vertical position,
5. attach the lift roller assembly 26 and adjust the rollers 26g so that they roll smoothly on the surface of the roller plate 14e,
6. insert the transmission shaft support assembly 18 into a selected set of right and left support sleeves 14c, 14d,
7. insert the upper pivoting assembly 16 into the lower pivoting assembly 14 at its maximum height,
8. attach the bell-housing mounting and utility plate assembly 20 to the upper pivoting assembly. The mounting and utility plate 20a is held in place by the spring loaded locking pins 20e,
9. insert the rear transmission cradle assembly 22 into the cradle support sleeve 12k,
10. insert the output shaft of an automatic transmission 50 into the shaft insertion bore 18b on the transmission shaft plate 18a,
11. release the mounting and utility plate 20a from the left and right pivotal members 16a, 16d by releasing the spring loaded locking pin 20e,
12. bolt the mounting and utility plate 20a to the transmission bell housing,
13. activate the pivot shaft sleeve lift assembly 28 to lift the lower and upper pivoting assemblies 14, 16 to the desired height and insert a pin 12i into the concentric safety pin bores 12h, 14j.
14. the transmission 50 may be serviced in the vertical position or in a horizontal position. To place the transmission work station 10 in a horizontal position, loosen the threaded hand knob, grasp the handle 16g from the back and pull until the upper pivoting assembly rests upon the horizontal member 22d,
15. for additional safety, wrap the transmission safety strap 40 around the transmission,
16. to service a front wheel drive automatic transmission, complete steps 1–9 then proceed as follows:
17. attach the front wheel drive transmission mounting assembly 36 to the upper and lower lift support sleeves 14d as shown in FIG. 2,
18. insert the output shaft of the automatic transmission into the shaft insertion bore 18b,
19. rotate the swivelling horizontal sleeve 36q until the bell housing mounting plate 36w is under the transmission bell housing,
20. adjust the height of assembly 36 by rotating the handle 36z until the plate 36a is resting on the bell housing, and
21. bolt the plate 36w to the transmission bell housing or the transmission case.

While the invention has been described in complete detail and pictorially shown in the accompanying drawings it is not to be limited to such details, since many changes and modifications may be made to the invention without departing from the spirit and the scope thereof. For example, a light assembly could be easily attached to one of the structural members or a magnet could be attached to allow tools and parts to be temporarily held. Hence, it is described to cover any and all modifications and forms which may come within the language and scope of the claims.

I claim:

1. A transmission work station comprising:

(a) a base assembly comprising:
  (1) a base plate having a front and back section,
  (2) a center post sleeve attached to the front section of said base plate,
  (3) a lower vertical support sleeve attached to the back section of said base plate,
  (4) a longitudinal support attached between the back of said center post sleeve and front of lower vertical support sleeve, (b) a lower pivoting assembly pivotally mounted on the base comprising:
  (1) a right vertical sleeve having a right support sleeve rigidly attached normal to a lower-half inside-surface of said right vertical sleeve,
  (2) a left vertical sleeve having a left support sleeve rigidly attached normal to a lower-half inside surface of said left vertical sleeve,
  (3) a combination support sleeve attachment and roller plate rigidly attached to back surface of each said right and left vertical sleeves,
  (4) a center post sized to slideably fit into said center post sleeve and having rigidly and centrally attached to its upper end a pivot shaft sleeve,
  (5) a pivot shaft slideably inserted into said pivot shaft sleeve and having the ends of said pivot shaft rigidly attached to upper-half inside-surfaces of said right and left vertical sleeves such that said right and left vertical sleeves are free to pivot about said pivot shaft sleeve,
  (6) means to lock said pivot shaft at any of a plurality of angles, (c) an upper pivoting assembly pivotally mounted relative to said base comprising:
  (1) a right pivotal member having an upper end and a lower end that is sized to be slideably inserted into and held within said right vertical sleeve, (2) a left pivotal member having an upper end and a lower end that is sized to be slideably inserted into and held within said left vertical sleeve, (3) a handle having on each end a vertical portion respectively inserted over the right and left pivotal members, (d) a tail housing support assembly comprising:

(1) a trail housing plate having a centrally located shaft insertion bore therethrough, (2) means to releasably attach said plate to said right and left support sleeves, (e) a bell-housing mounting and utility plate assembly comprising:

(1) a mounting and utility plate having a set of transmission mounting bores therethrough that are specifically spaced to allow a variety of transmission bell housings to be attached, (2) means to attach said mounting and utility plate to said right and left pivotal member, (f) a rear transmission cradle assembly mounted on a rear portion of said base comprising:

(1) a vertical support member having an upper end and a lower end that is sized to slideably fit into said lower vertical support sleeve, (2) means to adjust and hold said vertical support member within said lower vertical support sleeve, (3) a horizontal member rigidly and centrally attached to the upper end of said vertical support member configured to support said upper pivoting assembly when the combination of said upper and lower pivoting assemblies are pivoted about said pivot shaft to recline in a horizontal or angled position, (g) a lift roller assembly comprising:

(1) an upwardly angled member having a forward end and a downwardly extending channel sized to slideably fit into and be held within said longitudinal support, (2) a T-section member centrally and rigidly attached to the forward end of said upwardly extending member, (3) a roller attached to ends of said T-section member where said roller has means so that the roller abuts a roller plate on said lower pivoting assembly, (h) a pivot shaft sleeve lift assembly mounted on said base comprising:

(1) a lift having a cradle that is sized to encompass the diameter of said pivot shaft sleeve, and (2) means to operate said lift, whereby said roller plate slides along said rollers as said lift assembly lifts said upper and lower pivoting assemblies.

2. A transmission work station comprising:

(a) a base assembly comprising:

(1) a base plate having a front section and a back section, (2) an enclosed reinforcing frame longitudinally attached to an upper surface of said base plate with a forward end of said frame having on each side a clearance slot, (3) a center post sleeve attached to said upper surface of said front section of said base plate and said frame and having a safety pin bore sized to accept a safety pin, (4) a lift pedestal attached to said base plate adjacent to each side of said center post sleeve, (5) a lift mounting plate attached to a front side of each of said lift pedestals and to said upper surface of said base plate with said mounting plate having a set of lift attachments, (6) a cradle support sleeve attached to said upper surface of said back section of said base plate and said frame and having a pin bore on its back surface, (7) a longitudinal support having a plurality of bolt bores on an upper side and being rigidly attached between said center post sleeve and said cradle support sleeve, (b) a lower pivoting assembly pivotally mounted on said base comprising:

(1) a right vertical sleeve having on its upper end a pin bore and having its bottom end located on the forward end of said reinforcing frame adjacent to said clearance slot, (2) a left vertical sleeve having on its upper end a pin bore and having its bottom end located on the opposite forward end of said reinforcing frame adjacent to said clearance slot, (3) a right support sleeve rigidly attached normal to a lower-half inside-surface of said right vertical sleeve, (4) a left support sleeve rigidly attached normal to a lower-half inside-surface of said left vertical sleeve, (5) a combination support sleeve attachment and roller plate means attached to a back surface of each said right and left vertical sleeves where said plate means has a width that allows a back of said horizontal support sleeve to be covered and attached, (6) a center post sized to slideably fit into said center post sleeve and having centrally attached to its upper end a pivot shaft sleeve and also having a plurality of safety pin bores sized to correspond with the safety pin bore on said center port sleeve, (7) a pivot shaft slideably inserted into said pivot shaft sleeve and having ends of said shaft rigidly attached to said right and left vertical sleeves such that said right and left vertical sleeves are free to pivot about said pivot shaft sleeve, (8) means to lock said pivot shaft at any of a plurality of angles (c) an upper pivoting assembly comprising:

(1) a right pivotal member having an upper end and a lower end with each end and center having a pin bore and where the lower end is sized to be slideably inserted into said right vertical sleeve with the corresponding pin bores in concentric alignment and held in place with an adjustment set pin, (2) a left pivotal member having an upper end and a lower end with each end and center having a pin bore, and where the lower end is slideably inserted into said left vertical sleeve with the corresponding pin bores in concentric alignment and held in place with an adjustment set pin, (3) a handle having integrally on each end a vertical portion with a pin bore, where the portions are inserted over upper ends of said right and left pivotal member with the corresponding pin bores in concentric alignment and held in place with an adjustment set pin, (d) a tail housing support assembly comprising:

(1) a tail housing plate having a centrally located shaft insertion bore therethrough, a set of shaft crank bores therethrough and bracket sleeve, (2) a right bracket having a first end and a second end where the first end is inserted into the corresponding end of said bracket sleeve and the second end is inserted into said right support sleeve, (3) a left bracket having a first end and a second end where the first end is inserted into said bracket sleeve and the second end is inserted into said left support sleeve, (e) a bell-housing mounting and utility plate assembly comprising:

(1) a mounting and utility plate having a set of transmission mounting bores therethrough that are specifically sized and spaced to allow various transmission bell housings to be attached and also having a right mounting slot and a left mounting slot, (2) a pair of spring-loaded locking pins rigidly attached to the bottom surface of said plate adjacent to each of said mounting slots, where said plate is attached to said transmission work station by inserting said right and left mounting slots into said right and left pivotal members respectively and inserting said spring loaded locking pin into the respective center pin bore on said right and left pivotal member, (f) a rear transmission-cradle assembly comprising:

(1) a vertical support member having an upper end, a lower end and a plurality of pin bores where said lower end is sized to slideably fit into said cradle support sleeve and to be held within said sleeve by an adjustment set pin inserted into a pair of concentric pin bores, (2) a horizontal member having two upwardly projecting vertical sections where said sections are spaced to allow said upper pivoting assembly to fit and rest between said sections when said upper and lower pivoting assemblies pivot about said pivot shaft to recline in an angled or horizontal position, (g) a lift roller assembly comprising:

(1) an upwardly angled member having a forward end, a downwardly extending channel sized to slideably fit into said longitudinal support and having a set of bolt bores, where said angled member is adjusted and held in place by inserting a bolt into a concentric pair of bolt bores on the channel and said longitudinal support, (2) a T-section member centrally and rigidly attached to the forward end of said upwardly angled member and having a vertical bolt bore on each end, (3) a roller support plate having a roller on its forward end and an adjustment slot where said plate is attached to said T-section member by inserting a bolt through the slot and the corresponding T-section bolt bore and whereby the plate is adjusted so that the roller abuts a roller plate located on said lower pivoting assembly, (h) a pivot shaft sleeve lift assembly comprising:

(1) a right and left lifts that rest upon said lift pedestal, (2) a lift cradle that is attached to each of said right and left lift, where said cradles are sized to encompass the diameter of said pivot shaft sleeve, and (3) means to move and control said lifts, whereby said roller plate slides along said rollers as said lifts lift said upper and lower pivoting assemblies.

3. The transmission work station as recited in claims 1 or 2 wherein said lower pivoting assembly is further comprised of an upper and a lower right support sleeve and an upper and a lower left support sleeve where said sleeves are attached normal to said right and left vertical sleeves.

4. The transmission work station as recited in claim 2 wherein said clearance slots are sized to allow said right and left vertical sleeves to clear said frame when said upper and lower pivoting assemblies are tilted to a horizontal position.

5. The transmission work station as recited in claims 1 or 2 wherein said means to lock include a threaded bore that allows a threaded hand knob to be inserted such that when said knob is tightened, said lower pivoting assembly remains set in a selected position.

6. The transmission work station as recited in claim 2 wherein said handle further comprises: connecting horizontal ends of said vertical portions.

7. The transmission work station as recited in claim 2 further comprising a transmission output shaft adjustment crank mountable or said tail housing support assembly consisting of a crank handle that drives a shaft receptacle and U-shaped pin clamp pins which are sized and spaced to enter the shaft crank bores on said transmission shaft plate.

8. The transmission work station as recited in claim 2 wherein the right and left lifts are pneumatic lifts having a pneumatic line connected from a pneumatic source to each of said lifts and also having a remotely operated pneumatic control valve.

9. The transmission work station as recited in claim 2 wherein the right and left lifts are hydraulic lifts having a hydraulic line connected from a hydraulic source to each of said lifts and also having a remotely operated hydraulic control valve.

10. The transmission Work station as recited in claim 2 wherein said tail housing plate further comprises a set of front wheel drive transmission attachment bores.

11. The transmission work station as recited in claims 1 or 2 wherein said right vertical sleeve and left vertical sleeve further comprise a side mounted transmission safety strap hook to which is attached an adjustable transmission safety strap.

12. The transmission work station as specified in claim 3 further comprising a front-wheel drive transmission mounting assembly comprising:

(a) a lower telescoping horizontal member that is sized to fit into the lower left support sleeve and having a pin bore that when in concentric alignment with the pin bore on said support sleeve is held in place by inserting an adjustment set pin, (b) a stationary horizontal member and inward end that is sized to fit into the upper left support sleeve and having a pin bore which is held in place by inserting an adjustment set pin, (c) a lower vertical sleeve being rigidly attached to said lower telescoping horizontal member, said stationary horizontal member and a first threaded member, (d) an upper vertical sleeve having a lower end and an upper end, said upper end including a first swivel pin bore, said upper end having rigidly attached a second threaded member located in-line with said first threaded member, (e) an extension post having its upper end slideably inserted into the lower end of said upper vertical sleeve and its lower end slideably inserted into the upper end of said lower vertical sleeve, (f) a swivelling horizontal sleeve having an inward end and an outward end and also having a swivel pin bore in concentric alignment with the swivel pin bore on said upper vertical sleeve, (g) a swivel pin inserted into the respective pin bores on said upper vertical sleeve and swivelling horizontal sleeve, (h) an extension arm sized to be slideably inserted into said swivelling horizontal sleeve, (i) a bell housing mounting plate attached to said extension arm with said plate having a set of transmission mounting bores therethrough that are specifically spaced to allow a variety of front wheel drive transmission bell housings to be attached, and (j) a crank having a threaded shaft with a handle on its top end, where the threaded shaft is threaded into the first and second threaded members where said crank allows the swivelling horizontal sleeve to be adjusted in elevation.

* * * * *